United States Patent [19]

Andoh

[11] 3,970,052

[45] July 20, 1976

[54] APPARATUS FOR CONTROLLING NOXIOUS EXHAUST GASES FROM INTERNAL-COMBUSTION ENGINE

[75] Inventor: Akira Andoh, Yokohama, Japan

[73] Assignee: Clemix Co., Tokyo, Japan

[22] Filed: Oct. 29, 1974

[21] Appl. No.: 518,937

[52] U.S. Cl. ..... 123/25 R; 123/117 A; 123/119 A; 123/119 D; 123/25 L

[51] Int. Cl.[2] ..... F02D 19/00

[58] Field of Search ..... 123/1 A, 25 R, 25 A, 123/119 D, 119 DB, 119 A, 117 A, 124 R

[56] References Cited

UNITED STATES PATENTS

| | | | |
|---|---|---|---|
| 2,681,048 | 6/1954 | Fox | 123/25 R |
| 3,682,142 | 8/1972 | Newkirk | 123/1 A X |
| 3,712,281 | 1/1973 | Ruth | 123/119 A |
| 3,812,832 | 5/1974 | Scott | 123/119 A |
| 3,817,221 | 6/1974 | Nohira et al. | 123/119 A X |
| 3,817,222 | 6/1974 | Staib | 123/119 A X |
| 3,834,359 | 9/1974 | Ando | 123/1 A |
| 3,866,579 | 2/1975 | Serruys | 123/25 R X |
| 3,890,946 | 6/1975 | Wahl | 123/1 A X |

*Primary Examiner*—Charles J. Myhre
*Assistant Examiner*—Ira S. Lazarus
*Attorney, Agent, or Firm*—Wenderoth, Lind & Ponack

[57] ABSTRACT

An apparatus for controlling and minimizing the production of the noxious exhaust gases from an automobile internal-combustion engine, comprising two passageways extending from an intake manifold provided with a throttle valve therein which is located between the two passage ways, one of the two passageways leading to a first control section provided with a diaphragm therein which is actuated in response to changes in the vacuum from the intake manifold for controlling the supply of water or like and air to the combustion chamber and the other leading to a second control section provided with a diaphragm therein which is actuated in the same manner for controlling the supply of part of the exhaust gases and air to the combustion chamber for reburning them, thereby enabling the supply of water or like, air and exhaust gases to be controlled according to the amount and type of the noxious exhaust gases.

10 Claims, 10 Drawing Figures

(a)

I --- Idling
II --- Accelerating
III --- Normal
IV --- Slow down
I II III IV I
Km/hr
t (hr)
vacuum in pipe 5 (mm Hg)
-100
-450 t (hr)
vacuum in pipe 6 (mm Hg)
-500
A1 ON OFF
E ON OFF
W ON OFF
A2 ON OFF (a)

(b)

APPARATUS FOR CONTROLLING NOXIOUS EXHAUST GASES FROM INTERNAL-COMBUSTION ENGINE

BACKGROUND OF THE INVENTION

It is known that the vacuum from the intake manifold of an automobile engine is always changing under different load or speed conditions of the engine, and is also changing as a function of the torque which occurs with the turning of the engine.

The present applicant filed an application for his earlier invention and was granted a patent (U.S. Pat. No. 3,834,359) therefor. In that patent, he claimed a method of and an apparatus for minimizing the amount of noxious gases from the engine by injecting a controlled amount of water into the combustion chamber in proportion to changes in the intake vacuum. Recently, he has discovered from experiments that the supply of water is particularly effective for minimizing the amount of nitrogen oxides($NO_x$) that increase as the engine speed is accelerating and constant, and the supply of air is particularly effective for carbon monoxides ($CO_x$) and hydrocarbons(HC) which increase as the engine speed diminishes. This means that the supply of water is not important for nitrogen oxides the production of which is negligible when the engine speed diminishes. From the above observation, he has developed effective and economical improved means of controlling the production of noxious gases such as carbon monoxides ($CO_x$), nitrogen oxides($NO_x$) and hydrocarbons(HC) particularly by injecting proper amounts of water and/or air into the combustion chamber. In order to realize such improved means, then, he has sought the type and amount of these noxious gases that are produced under different load or speed conditions of the engine such as idling, accelerating, normal and slow-down, and obtained the results for each type of engine condition which will be described hereinafter.

The quantities of water and/or air to be injected were determined on the basis of these results and controlled in response to changes in the intake vacuum. Therefore, two valve means for water and air were provided which were automatically actuated to open and close in response to such changes in the intake vacuum. In his further study of the improved means, however, he has encountered a problem since in the improved means, too large an amount of water must be used for minimizing the amount of noxious gases such as nitrogen oxides in particular and this requires a large-sized apparatus. It has also been revealed that the supply of water cannot be controlled when a lower intake vacuum condition continues when the engine is out of order or during cold winter days, for example, resulting in a larger amount of water being injected.

SUMMARY OF THE INVENTION

The present invention was arrived at after the series of studies and experiments described above.

It is therefore one object of the present invention to provide an apparatus for controlling the production of noxious exhaust gases in an internal-combustion engine, in which the supply of water or water containing some additions (hereinafter refered to simply as "water") and air is controlled in response to changes in the vacuum in the intake manifold and the passageway leading from the carburetor to the spark advancer, and means is provided for recycling the unburned part of the exhaust gases to the combustion chamber for reburning, thereby reducing the amount of water to substantially 1/10 of that of the conventional apparatus.

It is another object of the present invention to provide an apparatus of the kind in which the minimum required amount of water is automatically supplied to the combustion chamber so as to control the production of nitrogen oxides ($NO_x$) in particular, and the minimum required amount of air is automatically supplied to the combustion chamber so as to control the production of carbon monoxides($CO_x$) and hydrocarbons(HC), including means provided for recycling the unburned part of the noxious gases to the combustion chamber for reburning thereby reducing the amount of water to a considerable degree.

It is still another object of the present invention to provide an apparatus of the kind in which the supply of water, air and unburned part of the gases is controlled in response to changes in the vacuum from the intake manifold and the vacuum in the passageway to the spark advancer.

It is a further object of the present invention to provide an apparatus of the kind in which a first control section is provided with a diaphragm which is actuated in response to changes in the intake vacuum for controlling the supply of water and air to the combustion chamber, a second control section is provided with a diaphragm which is actuated in the same manner for controlling the supply of air and part of the exhaust gases to the combustion chamber, and valve means are provided which are actuated with movement of each of the diaphragms for transmitting the vacuum in the spark advancer to the first control section for actuating the diaphragm therein and the vacuum in the intake manifold to the second control section for actuating the diaphragm therein, thereby supplying the amount of water, air and the unburned part of the exhaust gases effective for controlling the production of the noxious gases such as nitrogen oxides, carbon monoxides and hydrocarbons according to the type and amount of the gases to be produced under different speed conditions of the engine.

It is a still further object of the present invention to provide an apparatus of the kind in which regulator valve means is provided in the first control section to reinstate the diaphragm as early as possible so as to control the supply of water or like to a required minimum.

DESCRIPTION OF THE PREFERRED EMBODIMENTS

As has been disclosed heretofore, the present invention provides an apparatus for controlling and minimizing the amount or production of the noxious gases from the internal-combustion engine by supplying a controlled minimum amount of water and air, and recycling the unburned part of the gases into the combustion chamber according to the type and amount of the gases produced.

Figures 3A, 3B, 3C:
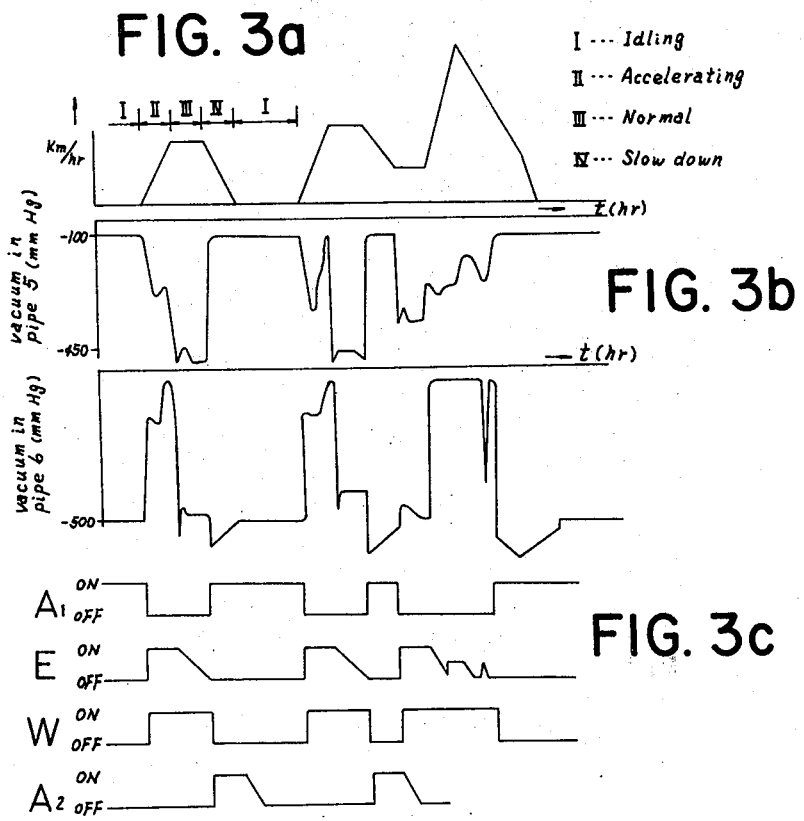
FIGS. 3*a*—3*c* are diagrams showing variations in the vacuum in the first and second control sections and in the supply of water, air and the unburned part of exhaust gases; under different load conditions of the engine (4-mode and 7-mode speeds)

Now, the present invention will further be described by way of preferred embodiments by reference to the accompanying drawings, in which:

Reference numeral 1 denotes a pipe which connects an air cleaner 2 and an intake manifold 3 and in which a throttle valve 4 is interposed. The pipe 1 has branch pipes 5, 6 earlier referred to as "passageways" but substantially identical which extend from the lateral wall of the pipe 1 and are located on opposite sides of the throttle valve 4. Reference numeral 7 is a water and air control section (hereinafter referred to as the "first control section") which is connected to the branch pipe 5. The branch pipe 5 has a passage 8 leading to a spark advancer (not shown) for transmitting the vacuum to the spark advancer which is actuated under the vacuum. There is provided another air cleaner 9 to supply clean air to the intake manifold 3. The first control section is connected through an electrically-powered pump 10 to a water tank 11. Reference numeral 12 denotes a control section for recycling part of the exhaust gases and supplying air (hereinafter referred to as the "second control section") which is connected to the branch pipe 6 and is also connected to a reservoir 13 for the exhaust gases. Reference numeral 14 is a combustion chamber. An apparatus provided according to the present invention is generally constructed such that the exhaust gases that are produced in the combustion chamber 14 are collected by an exhaust manifold 15 leading through mufflers 16, 17 to valve mechanism 18 which is actuated to discharge the exhaust gases to the atmosphere. In other words, the valve mechanism 18 is operated to open when the pressure within the exhaust manifold 15 is above a given value, and is of a cylinder shape and is fitted onto an outlet port 17*a* of the muffler 17. The valve mechanism 18 has a pipe 19 leading to the reservoir 13. At the outlet side of the valve mechanism 18, there is provided a cover plate 21 with an opening 20 for passing the exhaust gases into which opening 20 a rod member 22 is inserted. A valve 23 is pivotably supported by the member 22 which is loaded with a spring 24 normally urging the valve 23 toward the outlet side of the valve mechanism 18. The valve 23 is normally closed when the pressure within the exhaust manifold 15 is below a given value to deliver the exhaust gases to the reservoir 13. There is provided a distribution pipe 25 located near a point where the pipe 1 and the intake manifold 3 are connected. The distribution pipe 25 is connected to an electromagnetically-actuated valve W for controlling the supply of water and an electromagnetically-actuated valve $A_2$ for controlling the supply of air, the two valves W and $A_2$ being operated by the action of the first control section 7. The distribution pipe 25 is also connected to an electromagnetically-actuated valve E for controlling the supply of the exhaust gases and an electromagnetically-actuated valve $A_1$ for controlling the supply of air, the two valves E and $A_1$ being operated by the action of the second control section 12. In this manner, water, air and exhaust gases for reburning are distributed through passages 25*a*, 25*b* and 25*c* to the distribution pipe 25, respectively. The supply of water or like, air and exhaust gases for reburning is controlled by diaphragms 26, 27 provided in the first control section 7 and the second control section 12, respectively said diaphragms 26, 27 being actuated in response to changes in the vacuums in the pipes 5, 6, respectively. More particularly, the first control section is divided by the diaphragm 26 into two rooms 7*a*, 7*b*, said diaphragm 26 being provided with members 28*a*, 28*b* extending into their respective rooms 7*a*, 7*b*. Switches 29*a*, 29*b* are provided opposite their respective members 28*a*, 28*b;* when the contact 30*a* of the switch 29*a* is closed, it actuates the valve W to open for supplying water of like to the passage 25*b*, and when the contact 30*b* of the switch 29*b* is closed, it actuates the valve $A_2$ to open for supplying air to the passage 25*a*. The two rooms 7*a*, 7*b* separated by the diaphragm 26 then communicated with each other by means of a pressure regulator valve 30. The diaphragm 26 is actuated to expand or contract in response to changes in the pressure in either of the two rooms 7*a*, 7*b*, but the regulator valve 30 is then operated to gradually place the rooms 7*a*, 7*b* under equal pressure, thus returning the diaphragm 26 in position for stopping the supply of water or like as quickly as possible as shown in FIG. 3(c).

There is provided a diaphragm 27 within the second control section 12, the diaphragm 27 being actuated in response to changes in the vacuum from the intake manifold 3 and provided with a member 31. A switch 32 which is located opposite the member 31 is normally operated to make contact with a stationary terminal 32*a* to open the valve E for supplying the exhaust gases for reburning to the passage 25*c*, and is operated in response to an increase in the intake vacuum to cause the switch 32 to make contact with a stationary terminal 32*b* so as to open the valve $A_1$ for supplying air to the passage 25*a*. In the drawing, reference numeral 33 denotes a water injection nozzle, and 34 denotes a spring which urges the diaphragm 27 toward its normal position.

The apparatus according to the present invention has heretofore been illustrated with respect to the construction thereof. Now, the operation of the apparatus will be described by referring to FIGs. 2*a*—2*d* and 3, in which a four- mode condition of an engine, for example, is given such as idling, acceleration, normal and slow-down.

As mentioned earlier, different types of exhaust gases are produced under different load conditions. It is known that the supply of water or like is particularly effective for controlling the production of nitrogen oxides whereas the supply of air is particularly effective for controlling the production of carbon monoxides and hydrocarbons.

Firstly, when the engine is running idle or at no load, the vacuums in the pipes 5, 6 are shown in FIG. 3(b). It is seen from FIG. 3(b) that the vacuum in the pipe is near the atmospheric pressure of about −100 mmHg, and the diaphragm 26 within the first control section 7 is therefore in a neutral position as shown in FIG. 2(b), thus placing the members 28a and 28b in such a neutral position as to keep the switches 29a and 29b away from the terminals 30*a* and 30*b*. The vacuum in the pipe 6 is so low, e.g. −450 to −500 mmHg that it attracts the diaphragm 27 to cause the member 31 to establish an electrical contact between the switch 32 and the terminal 32*b* as shown in FIG. 2(b). The electromagnetically-actuated valve $A_1$ is then operated to open so as to supply 10 to 13l/min. of clean air from the air cleaner 9 and through passages 25*a*, 25 to the intake manifold 3 for reburning and purging the unburned part of the exhaust gases such as carbon monoxides and hydrocarbons which are particularly produced when the engine is running idle.

Secondly, when the engine speed is accelerating, the vacuums in the pipes 5, 6 are gradually decreasing as shown in FIG. 3(b). The pressure within the room 7*a* of the first control section 7 is accordingly reduced as shown in FIG. 2(c), thus attracting the diaphragm 26 to cause the member 28*a* to turn on the switch 29*a*. The electromagnetically-actuated valve W is then actuated to open so as to supply a maximum 30 to 40 cc/min. of water per two liters of displacement of an engine from the tank 11 and through the pump 10 to the passage 25*b* and to the intake manifold 3, thus controlling the production of nitrogen oxides in particular. At this moment, the vacuum in the pipe 6 is coming near or approaching the atmospheric pressure, and thus urges the diaphragm 27 to move toward the room 12*b*, causing the member 31 to move the switch 32 away from the terminal 32*b*. The switch 32 is then brought into contact with the terminal 32*a*. This actuates the electromagnetically-actuated valve E to open so as to supply a maximum 2l/min. of the exhaust gases for reburning from the reservoir 13 and through the passage 25*c* to the intake manifold 3.

Figure 1:
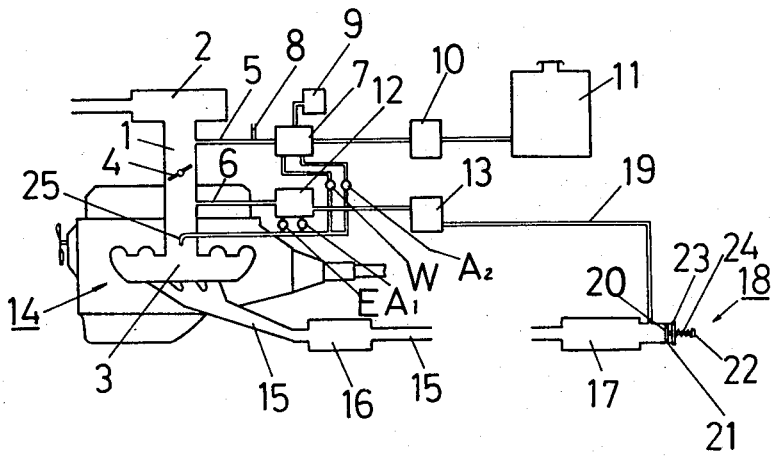
FIG. 1 is a schematic diagram of an apparatus embodying the present invention.
Figure 2:
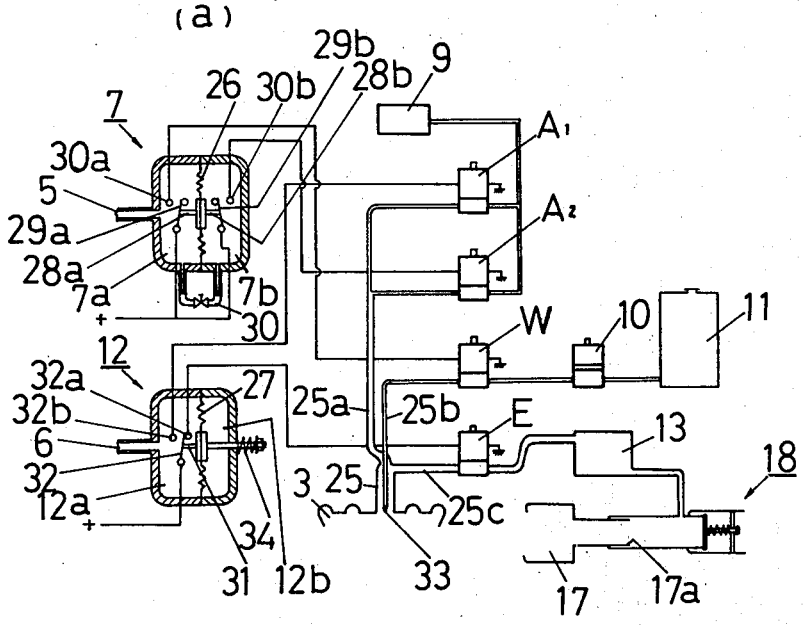
FIGS. 2*a*—2*d* are diagrams of one embodiment of first and second control sections showing the positions of the parts in the normal, idling, accelerating and slowing speeds of the engine respectively.
Figure 2B:
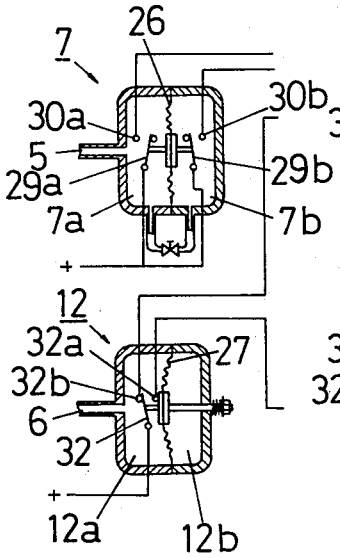
Figure 2C:
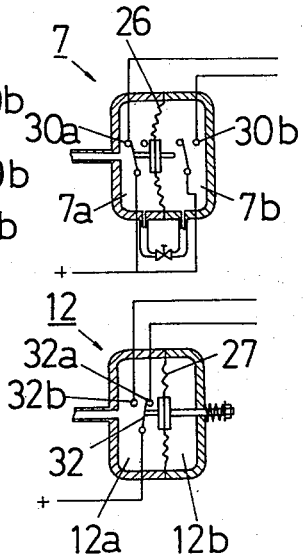

Thirdly, when the engine is running at normal or constant speeds, the vacuum in the pipe 5 is reduced to a maximum limit, placing the diaphragm 26 in the same position as when the engine is idling, as shown in FIG. 2(a). At the normal speed of the engine, the vacuum is the pipe 5 is under the maximum reduced condition, and is therefore so stable that a flow of pressure which places the room 7*b* at a higher level is then caused into the room 7*a* placed in a lower level through the regulator valve 32, thus actuating the diaphragm 26 gradually to move to a neutral position until the member 28*a* is finally caused to move the switch 29*a* away from the terminal 30*a* so as to actuate the valve W to stop the supply of water or like. With the supply of water or like thus interrupted as shown in FIG. 3(c), the exhaust gases are recycled from the reservoir 13 to the intake manifold 3 for reburning the unburned part of the gases in the combustion chamber 14.

Figure 2D:
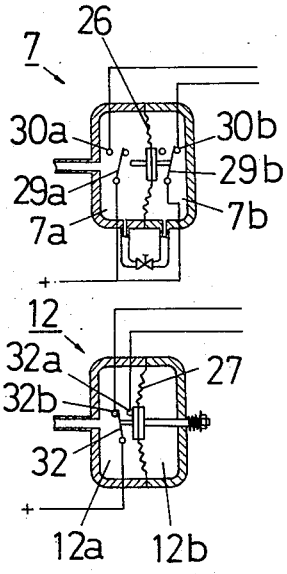

Fourthly, as the engine speed diminishes, the vacuum in the room 7*a* leading to the pipe 5 is approaching the atmospheric pressure, and is therefore at a higher level than in the room 7*b* as shown in FIG. 2(d), actuating the diaphragm 26 to cause the member 28*b* to turn on the switch 29*b* so as to allow the valve $A_2$ to open for supplying maximum 25l/min. of clean air from the air cleaner 9 and through the passage 25*a* to the manifold 3 for minimizing the amount of the exhaust gases produced at that time. At this moment, the supply of water or like is interrupted, of course. The pressure within the second control section 12 is then at the maximum reduced condition, which causes the switch 32 to make contact with the terminal 32*b* for actuating the valve $A_1$ to open so as to supply maximum 15l/min. of clean air to the intake manifold 3. This is particularly effective for controlling the amount of carbon monoxides and hydrocarbons produced during a slow-down of the engine.

When the pressure in the exhaust manifold 23 is above a given value, it actuates the valve 23 in the valve mechanism 18 to open against the spring 24 for expelling part of the exhaust gases to the atmosphere. The switches referred to in the earlier embodiments may be replaced by micro-switches.

Next, another preferred embodiment of the present invention will be described, in which a valve mechanism is provided in each of the first and second control sections in lieu of the electrically-actuated switching mechanism.

The first control section 7 is divided by the diaphragm 26 into the two rooms 7*a*, 7*b*, the diaphragm 26 having a hole 35 of small size through which the two rooms 7*a*, 7*b* are communicated with each other, and projections 36*a*, 36*b* each of substantially the same size as the hole. The room 7*a*, 7*b* has a chamber 37*a*, 37*b* for a valve mechanism therein, in which a valve 38*a*, 38*b* and valve seat 39*a*, 39*b* are provided. A rod member 40*a*, 40*b* is inserted through the valve 38*a*, 38*b* and a support member 41*a*, 41*b* to support the valve 38*a*, 38*b* and support member 41*a*, 41*b*. The rod member 40*a*, 40*b* includes a projection 42*a*, 42*b* rigidly secured at one end thereof, said projection 42*a*, 42*b* being caused to contact the projection 36*a*, 36*b*, and spring means 43*a*, 43*b* rigidly secured to the other end. The spring means 43*a*, 43*b* is supported by the lateral wall of the valve mechanism chamber 37*a*, 37*b*.

In addition to passages through which air flows to and and from the valve 38*b* in the chamber 37*b*, there may be provided a small hole 42 of diametrically about 1.5 mm size in the chamber 37*b* through which a small amount of air can be introduced even when the valve 38*b* is closed.

The entrance of the chamber 37*a* leads to the electrically-powered pump 10 earlier referred to, the exit of said chamber 37*b* leading to the passage 25*a*. As the second control section 12 is of a substantially identical construction, the foregoing description can be applied to it. Then, the following describes the operation of the first control section 7.

Figure 4:
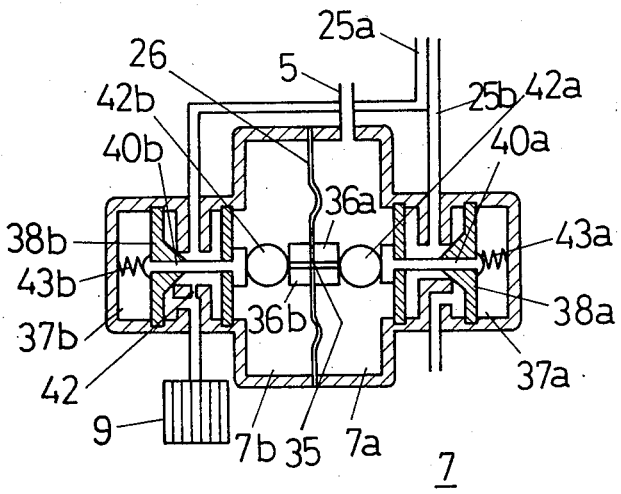
FIGS. 4*a*—4*c* are diagrams of a second embodiment of first and second control sections showing the positions of the parts in the normal, idling, accelerating and slowing speeds of the engine, respectively.
Figure 4:
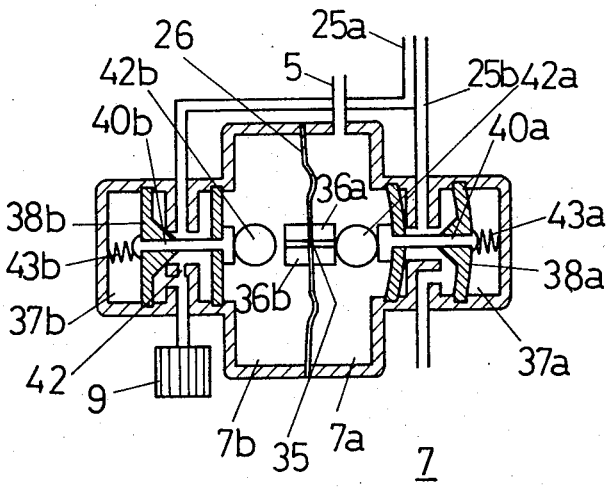

In the first instance, when the engine is running idle, the vacuum condition in the pipe 5 is near the atmospheric pressure which then places the diaphragm 26 in a neutral position as indicated in FIG. 4(a). The projections 36*a* and 36*b* are therefore placed in a neutral position, thus placing the valves 38*a* and 38*b* in a closed position. It will be understood that in this condition water or like and air are not supplied to the combustion chamber 14 from the first control section 7. However, if there is a hole 42 earlier referred to, a small amount of air is still supplied through the hole 42, and is then fed into the combustion chamber 14 with the controlled amount of air which is supplied from the second control section 12.

Secondly, when the engine speed is accelerating, the vacuum in the pipe 5 is gradually decreasing, actuating the diaphragm 26 to be deformed as indicated in FIG. 4(b) and causes the projection 36*a* to press the rod member 40*a*, so that water is fed from the tank 11 through the passage 25*b* to the combustion chamber 14.

Thirdly, when the engine is running at normal or constant speeds, the pressures in the rooms 7*a* and 7*b* become gradually equal or even as the pressures are evenly distributed to the rooms 7*a* and 7*b* through the hole 35, causing the valve 38*a* to be urged back by the spring means 43*a* as indicated in FIG. 4(a) so that no water or like is supplied by the first control section 7.

Fourthly, when the engine speed is diminishing, the vacuum in the pipe 5 is gradually approaching the atmospheric pressure, actuating the diaphragm 26 to be deformed as indicated in FIG. 4(c) to cause the projection 36*b* to press the rod member 40*b* for opening the valve 38*b*. In this condiction, therefore, air is fed from the air cleaner 9 through the valve 38*b* to the passage 25*a* and the combustion chamber 14.

The apparatus provided according to the present invention has advantages over the conventional apparatus of this kind.

One of the advantages is that it is possible to recover 30% or more of the loss in the power output of the engine as compared with the conventional apparatus which is only intended to reburn the recycled and unburned exhaust gases in the combustion chamber 14, and also to save fuel in an amount of 18 percent or more. This is because of the fact that the controlled amount of water and air is supplied to the intake manifold according to the type and amount of the exhaust gases, and that part of the exhaust gases are recycled between the combustion chamber and the apparatus for reburning that part in the combustion chamber.

Another advantage is the considerable reduction of the amount of water to be supplied, that is to say, about 2l of water saving per 50l of fuel. This is due to the fact that water or like as well as part of the exhaust gases can be supplied to the intake manifold at the same time.

The four-transmission mode has been referred to for the convenience of explanation, but the present invention can apply to the seven-transmission mode as provided for in the Muskie law.

It is desirable to use methanol or acetone as additions to be contained in the water.

According to the present invention, there are provided means for supplying controlled amounts of water and air into the combustion chamber, and means for recycling part of the exhaust gases to the intake manifold for reburning that part in the combustion chamber, thereby minimizing the amount of the noxious exhaust gases to be produced in the combustion chamber.

As can be understood from the above advantages, the apparatus according to the present invention provides an effective means of controlling the production of the noxious exhaust gases by supplying a much smaller amount of water or like than the conventional which includes only a means of supplying water and air.

What is claimed:

1. An apparatus for minimizing the amount of noxious gases such as nitrogen oxides, carbon monoxides and hydrocarbons contained in the exhaust gases to be produced by burning fuel in an internal-combustion engine, comprising a conduit leading to a combustion chamber of the engine for the supply of air-fuel mixture to said combustion chamber and provided with throttle valve means therein, two branch pipes extending from said conduit and located on opposite sides of said throttle valve means, respectively a first control section connected to one of said two branch pipes and operative for selectively controlling the supply of water and air to said combustion chamber, a second control section connected to the other of said two branch pipes and operative for controlling the supply of part of said exhaust gases and air to said combustion chamber for reburning said part of said exhaust gases and said air therein, a distribution pipe for the supply of the amount of said water and said air supplied by said first control section and for the supply of the amount said part of said exhaust gases and said air supplied by said control section and having one end thereof present inside said conduit or intake manifold connected to said conduit, and control elements provided in said first control section and actuated in response to changes in pressures within said first control section said second control section for controlling the flow of said water, air and exhaust gases.

2. An apparatus according to the claim 1 wherein said one of said two branch pipes includes a passage extending therefrom for actuating ignition advance means.

3. An apparatus according to claim 1 wherein said first control section includes a diaphragm separating said first control section into a first closed room and a second room connected to said conduit and actuated in response to pressure differences between said first closed room and said second room, and a pipe for connecting said first closed room and said second room having regulator valve means therein.

4. An apparatus according to claim 3, wherein said control elements comprise electrically-actuated switching means provided in said second control section and operative in response to movement of said diaphram in said second control section.

5. An apparatus according to claim 1 wherein said second control section includes a diaphragm separating said second control section into a first room connected to the atmosphere and a second room connected to said conduit and actuated in response to pressure differences between said first room and said second room.

6. An apparatus according to claim 5 wherein said control elements comprise electrically-actuated switching means provided in said second control section and operative in response to movement of said diaphragm in said second control section.

7. An apparatus according to claim 1 wherein said control elements comprise a pressure responsive valve actuated mechanism in said first control section, and a pressure responsive valve actuated mechanism in said second control section.

8. An apparatus according to claim 7 wherein said valve-actuated mechanism includes valve means.

9. An apparatus according to claim 7 wherein said valve-actuated mechanism in said first control section includes an air passage in the form of a small-size hole opening from the atmosphere into said first control sections for supply of air to said distribution pipe even when said valve actuated mechanism is closed.

10. An apparatus according to claim 7 wherein said first control section includes a diaphragm for separating said first control section into a first closed room and a second room connected to said conduit, said diaphragm being actuated in response to pressure differences between said first closed room and said second room and having a passage therethrough in the form of a small-size hole therein for restoring said diaphragm to an initial position promptly after it has moved in response to a pressure difference.

* * * * *